US010988822B2

(12) United States Patent
Uesaka et al.

(10) Patent No.: US 10,988,822 B2
(45) Date of Patent: Apr. 27, 2021

(54) GRAIN-ORIENTED ELECTRICAL STEEL SHEET AND METHOD FOR MANUFACTURING SAME

(71) Applicant: JFE STEEL CORPORATION, Tokyo (JP)

(72) Inventors: Masanori Uesaka, Tokyo (JP); Makoto Watanabe, Tokyo (JP); Shigehiro Takajo, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 155 days.

(21) Appl. No.: 15/549,742

(22) PCT Filed: Feb. 12, 2016

(86) PCT No.: PCT/JP2016/000744
§ 371 (c)(1),
(2) Date: Aug. 9, 2017

(87) PCT Pub. No.: WO2016/129291
PCT Pub. Date: Aug. 18, 2016

(65) Prior Publication Data

US 2018/0030559 A1 Feb. 1, 2018

(30) Foreign Application Priority Data

Feb. 13, 2015 (JP) ..... JP2015-026385

(51) Int. Cl.

| | |
|---|---|
| ***C21D 8/12*** | (2006.01) |
| ***C22C 38/02*** | (2006.01) |
| ***H01F 1/18*** | (2006.01) |
| ***C21D 9/46*** | (2006.01) |
| ***C22C 38/04*** | (2006.01) |
| ***C23C 22/00*** | (2006.01) |
| ***C21D 3/04*** | (2006.01) |
| ***C21D 6/00*** | (2006.01) |
| ***C21D 8/00*** | (2006.01) |
| ***H01F 27/245*** | (2006.01) |
| ***C22C 38/00*** | (2006.01) |
| ***H01F 1/16*** | (2006.01) |
| ***B05D 7/14*** | (2006.01) |

(52) U.S. Cl.
CPC ..... *C21D 8/1294* (2013.01); *B05D 7/14* (2013.01); *C21D 3/04* (2013.01); *C21D 6/005* (2013.01); *C21D 6/008* (2013.01); *C21D 8/005* (2013.01); *C21D 8/12* (2013.01); *C21D 8/1255* (2013.01); *C21D 8/1272* (2013.01); *C21D 9/46* (2013.01); *C22C 38/00* (2013.01); *C22C 38/02* (2013.01); *C22C 38/04* (2013.01); *C23C 22/00* (2013.01); *H01F 1/16* (2013.01); *H01F 1/18* (2013.01); *H01F 27/245* (2013.01); *C21D 8/1283* (2013.01); *C22C 2202/02* (2013.01)

(58) Field of Classification Search
CPC ..... C21D 12/83; C21D 9/46
See application file for complete search history.

(56) References Cited

U.S. PATENT DOCUMENTS

| | | | | |
|---|---|---|---|---|
| 4,293,350 | A | 10/1981 | Ichiyama et al. | |
| 8,557,058 | B2 | 10/2013 | Arita et al. | |
| 9,290,824 | B2 | 3/2016 | Watanabe et al. | |
| 2009/0047537 | A1 | 2/2009 | Nanba et al. | |
| 2010/0233484 | A1 | 9/2010 | Shigekuni et al. | |
| 2012/0131982 | A1 | 5/2012 | Imamura et al. | |
| 2013/0098508 | A1 | 4/2013 | Yamaguchi et al. | |
| 2013/0130043 | A1* | 5/2013 | Omura ..... | C21D 8/1255 428/450 |
| 2014/0234638 | A1 | 8/2014 | Takajo et al. | |
| 2015/0007908 | A1 | 1/2015 | Watanabe et al. | |

FOREIGN PATENT DOCUMENTS

| | | | | |
|---|---|---|---|---|
| CN | 103687967 | A | | 3/2014 |
| JP | S5518566 | A | | 2/1980 |
| JP | S56105421 | A | | 8/1981 |
| JP | S56123325 | A | | 9/1981 |
| JP | S6383227 | A | | 4/1988 |
| JP | H04165022 | A | | 6/1992 |
| JP | 06215622 | A | * | 8/1994 |
| JP | H10204533 | A | | 8/1998 |
| JP | 2861702 | B2 | | 2/1999 |
| JP | H11279645 | A | | 10/1999 |
| JP | 2000144249 | A | | 5/2000 |
| JP | 2004292834 | A | | 10/2004 |
| JP | 2012012666 | A | | 1/2012 |
| JP | 2012214902 | A | | 11/2012 |

(Continued)

OTHER PUBLICATIONS

Machine translation of JPH06-215622A, published Aug. 1994. (Year: 1994).*

Apr. 26, 2016, International Search Report issued in the International Patent Application No. PCT/JP2016/000744.

Nov. 21, 2017, Notification of Reasons for Refusal issued by the Japan Patent Office in the corresponding Japanese Patent Application No. 2016-574680 with English language Concise Statement of Relevance.

(Continued)

*Primary Examiner* — Monique R Jackson
(74) *Attorney, Agent, or Firm* — Kenja IP Law PC

(57) ABSTRACT

In a grain-oriented electrical steel sheet including: a steel substrate; a forsterite base film; and an insulating coating, critical damage shear stress τ between the forsterite base film and the steel substrate is 50 MPa or more and 200 MPa or less. Thus, a grain-oriented electrical steel sheet having excellent insulation property, stacking factor, and magnetic property is provided without coating damage even when magnetic domain refining treatment by thermal strain is performed.

3 Claims, 1 Drawing Sheet

(56) References Cited

FOREIGN PATENT DOCUMENTS

| | | | |
|---|---|---|---|
| JP | 2013057119 | A | 3/2013 |
| JP | 2013072116 | A | 4/2013 |
| JP | 2014196558 | A | 10/2014 |
| KR | 1020140023442 | A | 2/2014 |
| RU | 2395623 | C2 | 7/2010 |
| RU | 2409693 | C2 | 1/2011 |
| RU | 2496905 | C1 | 10/2013 |
| WO | 2013046716 | A1 | 4/2013 |

OTHER PUBLICATIONS

Nov. 30, 2017, Extended European Search Report issued by the European Patent Office in the corresponding European Patent Application No. 16748936.8.

Jul. 31, 2018, Office Action issued by the Federal Service for Intellectual Property, Patents and Trademarks of the Russian Federation in the corresponding Russian Patent Application No. 2017131867 with English language Search Report.

May 31, 2018, Office Action issued by the State Intellectual Property Office in the corresponding Chinese Patent Application No. 201680009784.1 with English language Search Report.

Nov. 7, 2018, Office Action issued by the Korean Intellectual Property Office in the corresponding Korean Patent Application No. 10-2017-7023335 with English language concise statement of relevance.

* cited by examiner

GRAIN-ORIENTED ELECTRICAL STEEL SHEET AND METHOD FOR MANUFACTURING SAME

TECHNICAL FIELD

The disclosure relates to a grain-oriented electrical steel sheet with iron loss being reduced by performing magnetic domain refining treatment by thermal strain on its surface.

BACKGROUND

Grain-oriented electrical steel sheets that contain Si and whose crystal orientation is (110)[001] orientation have excellent soft magnetic property, and so are widely used as various iron core materials in a commercial frequency domain. An important property required here is iron loss typically expressed as $W_{17/50}$ (W/kg), that is, a loss in the case of magnetization to 1.7 T at a frequency of 50 Hz. This is because the use of a material with a low $W_{17/50}$ value can significantly reduce no-load loss (energy loss) in an iron core of a transformer. Hence, the need to develop a material with low iron loss has been increasing every year.

Methods known to be effective in reducing iron loss in a grain-oriented electrical steel sheet include Si content increase, sheet thickness reduction, crystal orientation improvement, application of tension to the steel sheet, smoothing of the steel sheet surface, grain refinement of secondary recrystallized microstructure, and magnetic domain refining. Methods of magnetic domain refining include a heat resistant magnetic domain refining method of forming a groove or embedding a non-magnetic substance in the steel sheet surface, and a non-heat resistant magnetic domain refining method of introducing thermal strain into the steel sheet by a laser or an electron beam.

For example, JP S55-18566 A (PTL 1) proposes a non-heat resistant magnetic domain refining technique of irradiating a steel sheet after final annealing with a laser to introduce a high dislocation density region into the surface layer of the steel sheet.

Magnetic domain refining technology using laser irradiation has since been improved to enhance the iron loss reduction effect by magnetic domain refining (for example, JP S63-083227 A (PTL 2), JP H10-204533 A (PTL 3), and JP H11-279645 A (PTL 4)).

However, the non-heat resistant magnetic domain refining method of introducing linear thermal strain into the steel sheet surface by laser irradiation has a problem of widely damaging an insulating coating around a heat-affected zone and significantly decreasing insulation property when using steel sheets in a stacked state.

In view of this problem, the following techniques of repairing the steel sheet whose insulating coating is damaged by laser irradiation are proposed to improve insulation property: the application of an organic coating in JP S56-105421 A (PTL 5); the application of a semi-organic coating in JP S56-123325 A (PTL 6); and the application of an inorganic coating in JP H04-165022 A (PTL 7).

CITATION LIST

Patent Literatures

PTL 1: JP S55-18566 A
PTL 2: JP S63-083227 A
PTL 3: JP H10-204533 A
PTL 4: JP H11-279645 A

PTL 5: JP S56-105421 A
PTL 6: JP S56-123325 A
PTL 7: JP H04-165022 A

SUMMARY

Technical Problem

With the aforementioned various techniques, given that laser irradiation after the formation of a ceramic base film and an insulating coating damages the coating, a step of applying an insulating coating again after the laser irradiation step is newly required. The addition of such a step inevitably results in higher manufacturing cost. Besides, in the case of applying an insulating coating again, the proportion of the components other than the iron component increases. This lowers the stacking factor when using the steel sheet as an iron core, and degrades its performance as an iron core material.

Solution to Problem

We repeatedly studied an ideal magnetic domain refining technique that does not damage the coating by magnetic domain refining treatment by thermal strain to prevent a decrease in insulation property and stacking factor.

As a result, we discovered the following: By uniformly forming, on the steel sheet surface, the ceramic base film that firmly adheres to the steel substrate, evaluating the adhesion of the steel sheet surface by a scratch test from the coil immediately before magnetic domain refining treatment, and selecting a material suitable for the magnetic domain refining treatment, a decrease in insulation property due to insulating coating damage can be prevented, and a grain-oriented electrical steel sheet having excellent magnetic property is obtained with no need for re-coating after laser irradiation.

The disclosure is based on the aforementioned discoveries.

In detail, we provide the following:

1. A grain-oriented electrical steel sheet comprising:

a steel substrate;

a ceramic base film; and an insulating coating, wherein critical damage shear stress $\tau$ between the base film and the steel substrate is 50 MPa or more.

2. The grain-oriented electrical steel sheet according to 1., wherein the grain-oriented electrical steel sheet has a non-heat resistant magnetic domain refining region, and wherein a heat-affected width w is 50 μm or more and $(2\tau+150)$ μm or less, the heat-affected width w being a width of a thermal strain portion in the magnetic domain refining region.

3. A method for manufacturing a grain-oriented electrical steel sheet, comprising:

hot rolling a steel material containing C: 0.10 mass % or less, Si: 2.0 mass % to 4.5 mass %, and Mn: 0.005 mass % to 1.0 mass %, to obtain a hot rolled sheet;

optionally hot band annealing the hot rolled sheet;

thereafter cold rolling the hot rolled sheet either once, or twice or more with intermediate annealing performed therebetween, to obtain a cold rolled sheet having a final sheet thickness;

thereafter performing decarburization annealing that also serves as primary recrystallization annealing on the cold rolled sheet, to obtain a decarburization annealed sheet;

thereafter applying an annealing separator having MgO as a main component, to a surface of the decarburization annealed sheet;

thereafter final annealing the decarburization annealed sheet; and performing insulating coating treatment on the decarburization annealed sheet after the final annealing, wherein the following conditions (1) to (4) are satisfied:

(1) oxides in an internal oxidation layer formed as a surface of the decarburization annealed sheet, upon measuring a peak Af of $Fe_2SiO_4$ and a peak As of $SiO_2$ in an infrared reflection spectrum of the internal oxidation layer, have compositions satisfying a peak ratio Af/As of 0.4 or less;

(2) spherical silica at a depth of 0.5 μm from a surface of the internal oxidation layer has a mean diameter of 50 nm to 200 nm;

(3) one or more metal oxides selected from $CuO_2$, $SnO_2$, $MnO_2$, $Fe_3O_4$, $Fe_2O_3$, $Cr_2O_3$, and $TiO_2$ are added in an amount of 2 mass % to 30 mass % to the annealing separator; and (4) a duration for raising the temperature from 950° C. to 1100° C. during the final annealing is 10 hours or less.

4. The method for manufacturing a grain-oriented electrical steel sheet according to 3., further comprising performing non-heat resistant magnetic domain refining treatment after the insulating coating treatment to form a magnetic domain refining region having a thermal strain portion, wherein a heat-affected width w that is a width of the thermal strain portion is 50 μm or more and (2τ+150) μm or less.

Advantageous Effect

It is thus possible to provide an electrical steel sheet having excellent iron loss property without an additional step for repair, because the insulation property of the steel sheet surface is not damaged by magnetic domain refining treatment by thermal strain. It is also possible to provide a transformer having low energy loss, because an insulating coating need not be applied again and so the stacking factor when using the steel sheet as a transformer iron core is high.

BRIEF DESCRIPTION OF THE DRAWINGS

In the accompanying drawings:

FIG. 1 is a diagram illustrating the relationship between the critical damage shear stress τ and the coating damaged part area ratio a.

DETAILED DESCRIPTION

Figure 1:
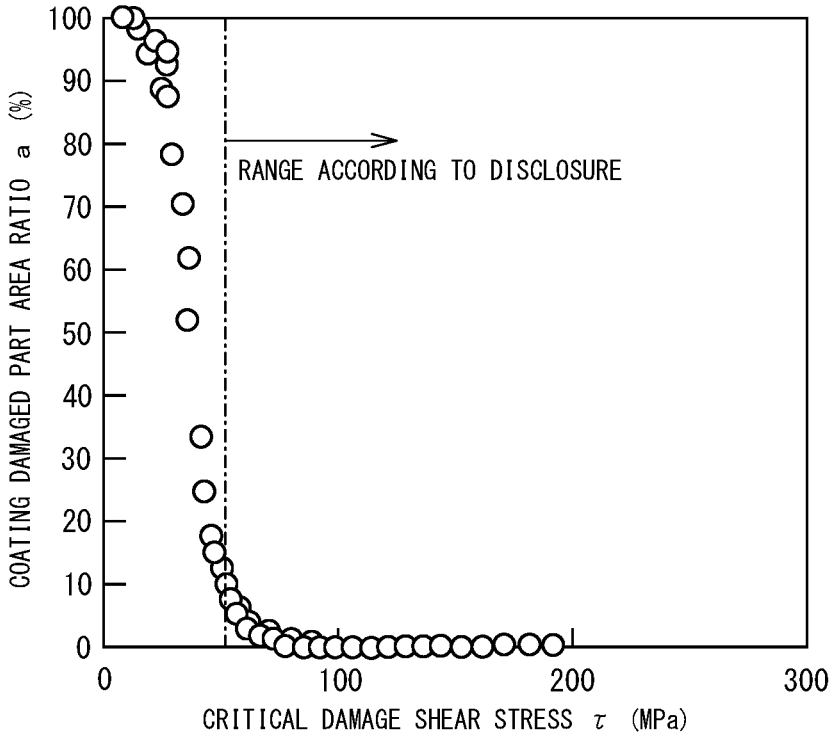

One of the disclosed embodiments is described in detail below.

The chemical composition of a slab for a grain-oriented electrical steel sheet used in this embodiment may be basically such a chemical composition that enables secondary recrystallization. In the case of using an inhibitor for inhibiting normal grain growth during secondary recrystallization, for example, Al and N are added in appropriate amounts when using a AlN-based inhibitor, and Mn and Se and/or S are added in appropriate amounts when using a MnS/MnSe-based inhibitor. Both inhibitors may be used together. Preferable contents of Al, N, Mn, S, and Se in this case are, in mass %, Al: 0.01% to 0.065%, N: 0.005% to 0.012%, Mn: 0.005% to 1.0%, S: 0.005% to 0.03%, and Se: 0.005% to 0.03%.

An inhibitorless grain-oriented electrical steel sheet in which the contents of Al, N, S, and Se are limited may be used in this embodiment. In such a case, the contents of Al, N, S, and Se are preferably limited to, in mass ppm, Al: 100 ppm or less, N: 50 ppm or less, S: 50 ppm or less, and Se: 50 ppm or less.

The basic components and optionally added components of a preferable slab for a grain-oriented electrical steel sheet in this embodiment are described in detail below. In the following description, "%" and "ppm" with regard to a steel sheet denote mass % and mass ppm, unless otherwise noted.

C: 0.10% or Less

C is added to improve hot rolled sheet microstructure. If the C content is more than 0.10%, it is difficult to reduce C to 50 ppm or less at which magnetic aging does not occur during the manufacturing process. The C content is therefore preferably 0.10% or less. The lower limit is not particularly limited, as a material not containing C can still be secondary recrystallized.

Si: 2.0% to 4.5%

Si is an element effective in enhancing the electrical resistance of the steel and improving iron loss. If the Si content is less than 2.0%, the iron loss reduction effect is insufficient. If the Si content is more than 4.5%, workability decreases significantly, and magnetic flux density decreases, too. The Si content is therefore preferably in the range of 2.0% to 4.5%.

Mn: 0.005% to 1.0%

Mn is an element necessary for achieving favorable hot workability. If the Mn content is less than 0.005%, the effect of adding Mn is poor. If the Mn content is more than 1.0%, the magnetic flux density of the product sheet decreases. The Mn content is therefore preferably in the range of 0.005% to 1.0%.

In addition to the aforementioned basic components, the following elements may be contained as appropriate as magnetic property improving components.

At least one selected from Ni: 0.03% to 1.50%, Cr: 0.01% to 0.50%, Sn: 0.01% to 1.50%, Sb: 0.005% to 1.50%, Cu: 0.03% to 3.0%, P: 0.03% to 0.50%, and Mo: 0.005% to 0.10%

These elements are all useful for improving hot rolled sheet microstructure and improving magnetic property.

If the Ni content is less than 0.03%, the magnetic property improving effect is low. If the Ni content is more than 1.50%, secondary recrystallization is unstable, and magnetic property degrades. The Ni content is therefore preferably in the range of 0.03% to 1.50%.

If the Cr content is 0.01% or more, the interface between the ceramic base film and the steel substrate portion is rough, and thus increases in strength. If the Cr content is more than 0.50%, magnetic flux density decreases. The Cr content is therefore preferably in the range of 0.01% to 0.50%.

Sn, Sb, Cu, P, and Mo are each an element useful for improving magnetic property. If the content of each of these components is less than the aforementioned lower limit, the magnetic property improving effect is low. If the content of each of these components is more than the aforementioned upper limit, the development of secondary recrystallized grains is inhibited. The content of each of these components is therefore preferably in the aforementioned range.

The balance other than the components described above is Fe and incidental impurities mixed in the manufacturing process.

The slab having the chemical composition described above is heated and hot rolled according to a conventional method. Alternatively, the slab may be directly hot rolled without heating, after casting. In the case of a thin slab or thinner cast steel, it may be hot rolled and then subjected to the subsequent steps, or subjected to the subsequent steps without hot rolling.

After the hot rolling, the hot rolled sheet is optionally hot band annealed. For high development of Goss texture in the product sheet, the hot band annealing temperature is preferably in the range of 800° C. to 1100° C. If the hot band annealing temperature is less than 800° C., band texture in the hot rolling remains, making it difficult to realize homogenized primary recrystallized microstructure and inhibiting the development of secondary recrystallized grains. If the hot band annealing temperature is more than 1100° C., the grain diameter after the hot band annealing is excessively coarse, making it difficult to realize homogenized primary recrystallized microstructure.

Following this, the hot rolled sheet is cold rolled either once, or twice or more with intermediate annealing performed therebetween, to obtain a cold rolled sheet having final sheet thickness.

The cold rolled sheet is then subjected to primary recrystallization annealing (decarburization annealing), to obtain a decarburization annealed sheet. After this, an annealing separator is applied to the surface of the decarburization annealed sheet, and the decarburization annealed sheet is subjected to final annealing for the purpose of secondary recrystallization and forsterite base film formation.

The decarburization annealing is preferably performed in the temperature range of 800° C. to 900° C. for 60 s to 180 s.

The final annealing is preferably performed in the temperature range of 1150° C. to 1250° C. for 5 h to 20 h.

The forsterite base film is formed as a result of the reaction between $SiO_2$ formed in the decarburization annealing and MgO in the annealing separator. The forsterite base film remains in the product sheet, and its interface structure significantly influences the bonding force between the coating including the tension coating and the steel substrate. $SiO_2$ reacts with MgO while moving from inside the steel substrate toward the surface in the temperature range of 950° C. or more during the final annealing.

The composition of internal oxides formed in the surface of the decarburization annealed sheet is mainly $SiO_2$, but contains a small amount of $Fe_2SiO_4$. $Fe_2SiO_4$ is in the form of a thin film, and suppresses the diffusion of oxygen from the surface only in its surroundings. Hence, a high proportion of $Fe_2SiO_4$ tends to cause the formation of a non-uniform internal oxidation layer and lead to a coating failure.

We accordingly studied the influence of $Fe_2SiO_4$ on the coating formation. As a result, we discovered the following: when the compositions of the internal oxides are analyzed by infrared reflection spectroscopy to measure a peak Af of $Fe_2SiO_4$ appearing at the position of about 1000 $cm^{-1}$ and a peak As of $SiO_2$ appearing at the position of about 1200 $cm^{-1}$, a peak ratio Af/As of 0.4 or less is effective in forming a favorable forsterite base film. It was also discovered that if there is no $Fe_2SiO_4$ at all, the steel sheet is excessively nitrided in the final annealing, and the decomposition of a nitride such as MN is suppressed or a new nitride forms. This causes the normal grain growth inhibiting capability to deviate from an appropriate range, and lowers the degree of preferred Goss orientation of the secondary recrystallized grains. Therefore, Af/As is preferably 0.01 or more.

To set Af/As to 0.4 or less (and preferably 0.01 or more), it is preferable to set oxidizability of atmosphere $P(H_2O)/P(H_2)$ in the decarburization annealing step to the range of the following expression depending on the Si concentration ([Si] mass %) of the steel sheet:

$$-0.04[Si]^2+0.18[Si]+0.42>P(H_2O)/P(H_2)>-0.04[Si]^2+0.18[Si]+0.18.$$

When $SiO_2$ in the surface layer of the decarburization annealed sheet has a complex shape such as dendrites, $SiO_2$ moves toward the surface of the steel sheet by quick viscous flow during the final annealing. When $SiO_2$ has a spherical shape, on the other hand, $SiO_2$ moves toward the surface by slow diffusion in the steel. If the movement of $SiO_2$ to the surface delays, the interface between the formed forsterite base film and the steel substrate roughens, as a result of which the coating adhesion of the final annealed sheet is improved. Thus, the spherical shape of $SiO_2$ of the internal oxides in the decarburization annealed sheet is more advantageous for improving coating adhesion. Moreover, a larger diameter of the spherical oxide is likely to contribute to better coating adhesion, given that the diffusion of $SiO_2$ during the final annealing delays more when $SiO_2$ has a larger diameter.

We studied this point, and found out that coating adhesion is improved by setting the mean diameter of $SiO_2$ measured by removing an iron component portion by slow electropolishing from the surface to the depth of 500 nm, extracting it by a replica method, and conducting TEM observation, to 50 nm or more. The mean diameter of $SiO_2$ is preferably 75 nm or more and 200 nm or less.

To set the mean grain diameter of $SiO_2$ to 50 nm or more, it is preferable to limit the heating rate from 500° C. to 700° C. to 20° C./s or more and 80° C./s or less in the case where the Si content is less than 3.0%, and to 40° C./s or more in the case where the Si content is 3.0% or more, in order to adjust the diffusion of Si from inside the steel sheet in the decarburization annealing step.

We further discovered that adding, to the annealing separator, one or more metal oxides selected from $CuO_2$, $SnO_2$, $MnO_2$, $Fe_3O_4$, $Fe_2O_3$, $Cr_2O_3$, and $TiO_2$ which gently release oxygen at least between 800° C. and 1050° C. so that the total content of the added metal oxides is 2.0% to 30% is effective in improving coating adhesion. Oxygen released from such an annealing separator during the final annealing inhibits the decomposition and diffusion of $SiO_2$. This roughens the interface between the forsterite base film formed by the final annealing and the steel substrate, and improves adhesion. If the metal oxide content is more than the upper limit, metal remains in the steel as an impurity. Accordingly, the metal oxide content needs to be in the range of 30% or less. The metal oxide content is preferably in the range of 5.0% to 20%.

During the final annealing, in the temperature range of 950° C. to 1100° C., the movement of $SiO_2$ toward the surface is relatively fast, whereas the forsterite forming reaction is slow. We thus discovered that, by making the duration necessary for passing through the temperature range of 950° C. to 1100° C. 10 hours or less to initiate the forsterite forming reaction before $SiO_2$ completely moves to the surface, the interface between the forsterite base film and the steel substrate roughens and so the adhesion between the forsterite base film and the steel substrate portion is improved.

It is effective to perform flattening annealing for shape adjustment, after the final annealing. In this embodiment, an insulating coating is formed on the steel sheet surface before or after the flattening annealing.

This insulating coating is such a coating that can apply tension to the steel sheet for iron loss reduction. Examples of the tension-applying insulating coating include an inorganic coating containing silica and a ceramic coating by physical vapor deposition, chemical vapor deposition, or the like.

In this embodiment, after the formation of the tension coating, a sample subjected to non-heat resistant magnetic domain refining treatment is sorted by critical shear stress measurement (scratch test) described in JIS R 3255. In the scratch test, the coating is deformed while being pressed by a moving indenter, and the pressing load applied is increased continuously until the coating becomes unable to follow the deformation of the substrate. The minimum load at which a coating fracture occurs, called critical load Lc, is measured by checking the damaged position of the coating and the load from optical microscope observation. Here, the critical damage shear stress $\tau$ acting on the interface between the forsterite base film and the steel substrate is calculated by the method described in JIS R 3255, to evaluate the adhesion between the forsterite base film and the steel substrate portion.

When non-heat resistant magnetic domain refining treatment is performed, shear stress acts between the ceramic base film and the steel substrate portion. This shear stress breaks the interfacial bond and, when extended cracking reaches the surface, the coating peels off and is damaged.

We accordingly researched the relationship between the shear stress and the coating damage, and as a result discovered that, by selecting a material whose critical damage shear stress $\tau$ is 50 MPa or more as the coating material irradiated with a laser, an electron beam, or a plasma flame, not only the coating damage can be prevented, but also the decrease in coating tension as a result of the breaking of the bond between the ceramic base film and the steel substrate portion can be suppressed. The critical damage shear stress $\tau$ is further preferably 100 MPa or more. The upper limit of $\tau$ is about 200 MPa.

After sorting the sample, the non-heat resistant magnetic domain refining treatment is performed by irradiation with a laser, an electron beam, or a plasma flame.

Here, by increasing the power of the laser, electron beam, or plasma flame applied, the strain introduced into the steel substrate portion is increased, with which a greater magnetic domain refining effect can be expected. However, if the shear stress between the ceramic base film and the steel substrate portion increases due to the increased power, the interfacial bond is more likely to break.

We accordingly researched the relationship between the power of the laser or the like applied and the critical damage shear stress $\tau$, and as a result discovered that it is preferable to introduce thermal strain so that the heat-affected width w is in a range satisfying the following Expressions (1) and (2). Here, the heat-affected width w, that is, the width of the region in which the thermal strain is introduced, is measured by visualizing and identifying the magnetic domain structure by, for example, the Bitter method using a magnetic colloid. We also discovered that, to improve iron loss, it is preferable to introduce thermal strain in such a range that also satisfies the following Expressions (3) and (4):

$$\tau \geq 50 \text{ MPa} \quad (1)$$

$$w \leq 2\tau + 150 \ (\mu\text{m}) \quad (2)$$

$$\tau \geq 100 \text{ MPa} \quad (3)$$

$$2\tau + 150 \geq w \geq 50 \ (\mu\text{m}) \quad (4).$$

To adjust the heat-affected width w to the range satisfying Expressions (1) and (2), it is preferable to set the power to the range of 5 to 100 (J/m) in the case of laser irradiation, the power to the range of 5 to 100 (J/m) in the case of electron beam irradiation, and the power to the range of 5 to 100 (J/m) in the case of plasma flame irradiation. To adjust the heat-affected width w to the range also satisfying Expressions (3) and (4), it is preferable to set the power to the range of 10 to 50 (J/m) in the case of laser irradiation, the power to the range of 10 to 50 (J/m) in the case of electron beam irradiation, and the power to the range of 10 to 50 (J/m) in the case of plasma flame irradiation.

The irradiation interval and the irradiation direction when performing laser irradiation, electron beam irradiation, or plasma flame irradiation may be according to a conventional method.

EXAMPLES

Example 1

Steel containing C: 0.065%, Si: 3.4%, and Mn: 0.08% was obtained by steelmaking, and made into a steel slab by continuous casting. The steel slab was then heated to 1410° C., and hot rolled to obtain a hot rolled sheet with a sheet thickness of 2.4 mm. The hot rolled sheet was then hot band annealed at 1050° C. for 60 s, subjected to primary cold rolling to an intermediate sheet thickness of 1.8 mm, and, after intermediate annealing at 1120° C. for 80 s, warm rolled at 200° C. to obtain a cold rolled sheet with a final sheet thickness of 0.23 mm. Following this, the cold rolled sheet was subjected to decarburization annealing also serving as primary recrystallization annealing at 820° C. for 80 s in an oxidizing wet $H_2$—$N_2$ atmosphere. Subsequently, an annealing separator having MgO as a main component, to which $Cr_2O_3$ was added in the proportion changed in the range of 0% to 40%, was applied to the surface of the steel sheet and dried. After this, the steel sheet was subjected to final annealing including: secondary recrystallization annealing with the time for heating from 950° C. to 1100° C. being changed in the range of 5 h to 15 h; and purification treatment at 1200° C. for 7 h in a hydrogen atmosphere.

From the product sheet obtained in this way, 2 sets of 10 test pieces with a width of 100 mm were collected at 10 locations in the steel sheet width direction, for each condition. For 1 set, iron loss $W_{17/50}$ was measured by the method described in JIS C 2556, and a mean value was calculated. For the other set, critical damage shear stress $\tau$ was measured by the method described in JIS R 3255. With these iron loss measurement and coating adhesion measurement methods, the measurement values deteriorate in the case where the iron loss and the coating adhesion vary in the width direction. Hence, the evaluation of the iron loss and coating adhesion including their variations is possible. The scratch needle used when measuring the critical shear stress by the method described in JIS R 3255 had a spherical head of 1 mm R. The needle was moved at a rate of 10 mm/s, and the length of 500 mm was changed in the range of 1 N to 20 N. The hardness of the steel substrate under the coating, which is necessary for the calculation of $\tau$, was measured by Vickers hardness measurement after removing the coating by chemical polishing.

Further, each test piece already subjected to the magnetic property measurement was subjected to magnetic domain refining treatment of linearly applying laser light in the direction orthogonal to the rolling direction under the condition of an interval of 5 mm in the rolling direction and a heat-affected width of 150 μm, to obtain a grain-oriented electrical steel sheet that was magnetic domain refining treated. The iron loss $W_{17/50}$ of the steel sheet after the magnetic domain refining treatment was measured by the method described in JIS C 2556, and a mean value was calculated. The appearance of the coating after the laser light irradiation of the steel sheet was then visually inspected.

Table 1 shows the obtained results.

TABLE 1

| No. | Heating time from 950 to 1100° C. (h) | Additive amount of $Cr_2O_3$ (mass %) | Magnetic property before magnetic domain refining $B_8$ (T) | Magnetic property before magnetic domain refining $W_{17/50}$ (W/kg) | Magnetic property after magnetic domain refining $B_8$ (T) | Magnetic property after magnetic domain refining $W_{17/50}$ (W/kg) | Coating peel | Critical damage shear stress τ (MPa) | Remarks |
|---|---|---|---|---|---|---|---|---|---|
| 1 | 8 | 0 | 1.88 | 0.95 | 1.88 | 0.92 | Occurred | 10 | Comparative Example |
| 2 | 8 | 1 | 1.90 | 0.94 | 1.90 | 0.90 | Occurred | 20 | Comparative Example |
| 3 | 8 | 2 | 1.91 | 0.88 | 1.91 | 0.76 | Not occurred | 110 | Example |
| 4 | 8 | 15 | 1.93 | 0.85 | 1.93 | 0.72 | Not occurred | 140 | Example |
| 5 | 8 | 30 | 1.90 | 0.89 | 1.90 | 0.77 | Not occurred | 100 | Example |
| 6 | 8 | 40 | 1.91 | 0.89 | 1.91 | 0.87 | Occurred | 40 | Comparative Example |
| 7 | 5 | 15 | 1.91 | 0.86 | 1.91 | 0.72 | Not occurred | 130 | Example |
| 8 | 10 | 15 | 1.90 | 0.89 | 1.90 | 0.78 | Not occurred | 70 | Example |
| 9 | 15 | 15 | 1.89 | 0.91 | 1.89 | 0.89 | Occurred | 20 | Comparative Example |

As is clear from Table 1, each material with critical damage shear stress τ of 50 MPa or more had no coating peel, and had excellent iron loss.

Example 2

Steel containing C: 0.070%, Si: 3.2%, and Mn: 0.1% was obtained by steelmaking, and made into a steel slab by continuous casting. The steel slab was then heated to 1410° C., and hot rolled to obtain a hot rolled sheet with a sheet thickness of 2.4 mm. The hot rolled sheet was then hot band annealed at 1050° C. for 60 s, subjected to primary cold rolling to an intermediate sheet thickness of 1.9 mm, and, after intermediate annealing at 1120° C. for 80 s, warm rolled at 200° C. to obtain a cold rolled sheet with a final sheet thickness of 0.23 mm. Following this, the cold rolled sheet was subjected to decarburization annealing also serving as primary recrystallization annealing at 840° C. for 100 s in an oxidizing wet $H_2$—$N_2$ atmosphere. Subsequently, an annealing separator having MgO as a main component, to which 10% $Cr_2O_3$ was added, was applied to the surface of the steel sheet and dried. After this, the steel sheet was subjected to final annealing including: secondary recrystallization annealing; and purification treatment at 1200° C. for 7 h in a hydrogen atmosphere.

From the product sheet obtained in this way, 2 sets of 10 test pieces with a width of 100 mm were collected at 10 locations in the steel sheet width direction. For 1 set, critical damage shear stress τ was measured by the method described in JIS R 3255. For the other set, magnetic domain refining treatment of linearly applying an electron beam in the direction orthogonal to the rolling direction was performed to obtain a grain-oriented electrical steel sheet that was magnetic domain refining treated. The appearance of the coating after the electron beam irradiation of the steel sheet was then inspected using an optical microscope, and the area ratio a of the electron beam irradiation part and the coating damaged part was measured by image analysis.

FIG. 1 illustrates the result of studying the relationship between the critical damage shear stress τ and the area ratio a of the electron beam irradiation part and the coating damaged part.

As illustrated in FIG. 1, the value of a decreased with an increase of τ and there was almost no coating damage when τ was 50 MPa or more.

Example 3

Steel containing C: 0.070%, Si: 3.2%, and Mn: 0.1% was obtained by steelmaking, and made into a steel slab by continuous casting. The steel slab was then heated to 1410° C., and hot rolled to obtain a hot rolled sheet with a sheet thickness of 2.4 mm. The hot rolled sheet was then hot band annealed at 1050° C. for 60 s, subjected to primary cold rolling to an intermediate sheet thickness of 1.9 mm, and, after intermediate annealing at 1120° C. for 80 s, warm rolled at 200° C. to obtain a cold rolled sheet with a final sheet thickness of 0.23 mm. Following this, the cold rolled sheet was subjected to decarburization annealing also serving as primary recrystallization annealing at 840° C. for 100 s in an oxidizing wet $H_2$—$N_2$ atmosphere having oxidizability of atmosphere of $P(H_2O)/P(H_2)=0.40$. Subsequently, an annealing separator having MgO as a main component, to which 10% $Cr_2O_3$ was added, was applied to the surface of the steel sheet and dried. After this, the steel sheet was subjected to final annealing including: secondary recrystallization annealing; and purification treatment at 1200° C. for 7 h in a hydrogen atmosphere.

From the product sheet obtained in this way, 2 sets of 10 test pieces with a width of 100 mm were collected at 10 locations in the steel sheet width direction. For 1 set, critical damage shear stress τ was measured by the method described in JIS R 3255. For the other set, magnetic domain refining treatment of linearly applying an electron beam in the direction orthogonal to the rolling direction was performed to obtain a grain-oriented electrical steel sheet that was magnetic domain refining treated. Here, the heat-affected width formed by electron beam irradiation was changed in the range of 50 to 400 μm. The appearance of the coating after the electron beam irradiation of the steel sheet was then visually inspected.

Figure 2:
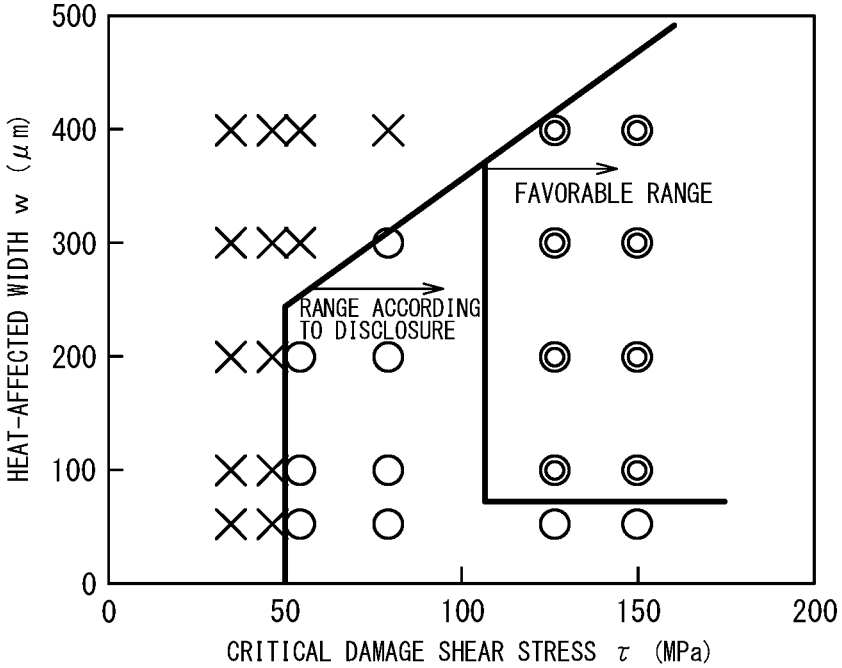
FIG. 2 is a diagram illustrating the influence of the critical damage shear stress τ and heat-affected width w on coating damage.

Table 2 shows the obtained results. Moreover, FIG. 2 summarizes the obtained results. In FIG. 2, the double circle mark indicates that no change was observed in the coating, the circle mark indicates that a trace which appeared to be coating damage was observed in a part, and the cross mark indicates that more coating damage than the above was observed.

TABLE 2

| No. | Critical damage shear stress τ (MPa) | Heat-affected width w (μm) | Magnetic property after magnetic domain refining $B_8$ (T) | $W_{17/50}$ (W/kg) | Coating peel | Remarks |
|---|---|---|---|---|---|---|
| 1 | 35 | 50 | 1.91 | 0.87 | Not occurred | Comparative Example |
| 2 | 35 | 100 | 1.91 | 0.85 | Occurred | Comparative Example |
| 3 | 35 | 200 | 1.91 | 0.83 | Occurred | Comparative Example |
| 4 | 35 | 300 | 1.91 | 0.83 | Occurred | Comparative Example |
| 5 | 35 | 400 | 1.91 | 0.82 | Occurred | Comparative Example |
| 6 | 47 | 50 | 1.91 | 0.87 | Not occurred | Comparative Example |
| 7 | 47 | 100 | 1.91 | 0.84 | Occurred | Comparative Example |
| 8 | 47 | 200 | 1.91 | 0.82 | Occurred | Comparative Example |
| 9 | 47 | 300 | 1.91 | 0.82 | Occurred | Comparative Example |
| 10 | 47 | 400 | 1.91 | 0.81 | Occurred | Comparative Example |
| 11 | 55 | 50 | 1.91 | 0.78 | Not occurred | Example |
| 12 | 55 | 100 | 1.91 | 0.76 | Not occurred | Example |
| 13 | 55 | 200 | 1.91 | 0.78 | Not occurred | Example |
| 14 | 55 | 300 | 1.91 | 0.81 | Occurred | Comparative Example |
| 15 | 55 | 400 | 1.91 | 0.81 | Occurred | Comparative Example |
| 16 | 80 | 50 | 1.91 | 0.78 | Not occurred | Example |
| 17 | 80 | 100 | 1.91 | 0.77 | Not occurred | Example |
| 18 | 80 | 200 | 1.91 | 0.76 | Not occurred | Example |
| 19 | 80 | 300 | 1.91 | 0.77 | Not occurred | Example |
| 20 | 80 | 400 | 1.91 | 0.81 | Occurred | Comparative Example |
| 21 | 127 | 50 | 1.91 | 0.77 | Not occurred | Example |
| 22 | 127 | 100 | 1.91 | 0.74 | Not occurred | Example |
| 23 | 127 | 200 | 1.91 | 0.73 | Not occurred | Example |
| 24 | 127 | 300 | 1.91 | 0.73 | Not occurred | Example |
| 25 | 127 | 400 | 1.91 | 0.72 | Not occurred | Example |
| 26 | 150 | 50 | 1.91 | 0.77 | Not occurred | Example |
| 27 | 150 | 100 | 1.91 | 0.73 | Not occurred | Example |
| 28 | 150 | 200 | 1.91 | 0.72 | Not occurred | Example |
| 29 | 150 | 300 | 1.91 | 0.72 | Not occurred | Example |
| 30 | 150 | 400 | 1.91 | 0.71 | Not occurred | Example |

As shown in Table 2 and FIG. 2, in the case where the critical damage shear stress τ and the heat-affected width w satisfied the following Expressions (1) and (2), no coating damage occurred, and excellent magnetic property was obtained:

$$\tau \geq 50 \text{ MPa} \quad (1)$$

$$w \leq 2\tau + 150 \ (\mu m) \quad (2).$$

Further, in the case where the critical damage shear stress τ and the heat-affected width w satisfied the following Expressions (3) and (4), better results were obtained:

$$\tau \geq 100 \text{ MPa} \quad (3)$$

$$2\tau + 150 \geq w \geq 50 \ (\mu m) \quad (4).$$

Example 4

Steel containing C: 0.065%, Si: 3.4%, and Mn: 0.08% was obtained by steelmaking, and made into a steel slab by continuous casting. The steel slab was then heated to 1410° C., and hot rolled to obtain a hot rolled sheet with a sheet thickness of 2.4 mm. The hot rolled sheet was then hot band annealed at 1050° C. for 60 s, subjected to primary cold rolling to an intermediate sheet thickness of 1.8 mm, and, after intermediate annealing at 1120° C. for 80 s, warm rolled at 200° C. to obtain a cold rolled sheet with a final sheet thickness of 0.23 mm. Following this, the cold rolled sheet was subjected to decarburization annealing also serving as primary recrystallization annealing at 820° C. for 50 s to 150 s in a wet $H_2$—$N_2$ atmosphere, while changing oxidizability of atmosphere $P(H_2O)/P(H_2)$ in the range of 0.02 to 0.6 as shown in Table 3.

Part of the decarburization annealed sheet obtained in this way was collected, and the ratio Af/As between a peak Af of $Fe_2SiO_4$ and a peak As of $SiO_2$ was measured from its infrared reflection spectrum. Internal oxides extracted by electropolishing from the depth of 0.5 μm from the surface were observed at 20 locations within the area of 5 $\mu m^2$ by TEM, and the mean grain diameter of spherical $SiO_2$ was measured. Subsequently, an annealing separator having MgO as a main component, to which $CuO_2$, $SnO_2$, $MnO_2$, $Fe_3O_4$, $Fe_2O_3$, $Cr_2O_3$, and $TiO_2$ were added in the proportion changed in the range of 0% to 25%, was applied to the surface of the steel sheet and dried. After this, the steel sheet was subjected to final annealing including: secondary recrystallization annealing with the duration for raising the temperature from 950° C. to 1100° C. being 8 h; and purification treatment at 1200° C. for 7 h in a hydrogen atmosphere.

From the product sheet obtained in this way, 2 sets of 10 test pieces with a width of 100 mm were collected at 10 locations in the steel sheet width direction, for each condition. For 1 set, iron loss $W_{17/50}$ was measured by the method described in JIS C 2556, and a mean value was calculated. For the other set, critical damage shear stress τ was measured by the method described in JIS R 3255.

Further, each test piece already subjected to the magnetic property measurement was subjected to magnetic domain refining treatment of linearly applying laser light in the direction orthogonal to the rolling direction with an interval of 5 mm in the rolling direction, to obtain a grain-oriented electrical steel sheet that was magnetic domain refining treated. The iron loss $W_{17/50}$ of the steel sheet after the magnetic domain refining treatment was measured by the method described in JIS C 2556, and a mean value was calculated.

The appearance of the coating after the laser light irradiation of the steel sheet was then visually inspected.

Table 3 shows the obtained results.

TABLE 3

| No. | $P(H_2O)/P(H_2)$ | Af/As | $SiO_2$ mean grain diameter (nm) | Additive element | Additive amount (mass %) | Magnetic property after magnetic domain refining $B_8$ (T) | $W_{17/50}$ (W/kg) | Coating peel | Critical damage shear stress τ (MPa) | Remarks |
|---|---|---|---|---|---|---|---|---|---|---|
| 1 | 0.02 | 0 | 45 | $CuO_2$ | 15 | 1.80 | 1.13 | Occurred | 30 | Comparative Example |
| 2 | 0.05 | 0.001 | 54 | $CuO_2$ | 15 | 1.91 | 0.77 | Not occurred | 55 | Example |
| 3 | 0.3 | 0.01 | 66 | $CuO_2$ | 15 | 1.92 | 0.76 | Not occurred | 70 | Example |
| 4 | 0.5 | 0.1 | 75 | $CuO_2$ | 15 | 1.92 | 0.73 | Not occurred | 120 | Example |
| 5 | 0.55 | 0.4 | 69 | $CuO_2$ | 15 | 1.90 | 0.75 | Not occurred | 90 | Example |
| 6 | 0.58 | 0.6 | 72 | $CuO_2$ | 15 | 1.88 | 0.89 | Occurred | 20 | Comparative Example |
| 7 | 0.6 | 0.9 | 90 | $CuO_2$ | 15 | 1.87 | 0.91 | Occurred | 20 | Comparative Example |
| 8 | 0.5 | 0.09 | 63 | — | 0 | 1.89 | 0.88 | Occurred | 35 | Comparative Example |
| 9 | 0.3 | 0.03 | 30 | $SnO_2$ | 15 | 1.86 | 0.95 | Occurred | 25 | Comparative Example |
| 10 | 0.3 | 0.02 | 45 | $SnO_2$ | 15 | 1.89 | 0.85 | Occurred | 40 | Comparative Example |
| 11 | 0.3 | 0.03 | 57 | $SnO_2$ | 15 | 1.90 | 0.78 | Not occurred | 60 | Example |
| 12 | 0.3 | 0.03 | 69 | $SnO_2$ | 15 | 1.92 | 0.77 | Not occurred | 75 | Example |
| 13 | 0.3 | 0.05 | 78 | $SnO_2$ | 15 | 1.91 | 0.73 | Not occurred | 110 | Example |
| 14 | 0.3 | 0.07 | 87 | $SnO_2$ | 15 | 1.92 | 0.72 | Not occurred | 120 | Example |
| 15 | 0.3 | 0.05 | 76 | $MnO_2$ | 15 | 1.92 | 0.72 | Not occurred | 120 | Example |
| 16 | 0.3 | 0.05 | 79 | $Fe_3O_4$ | 15 | 1.91 | 0.73 | Not occurred | 120 | Example |
| 17 | 0.3 | 0.05 | 77 | $Fe_2O_3$ | 15 | 1.92 | 0.73 | Not occurred | 130 | Example |
| 18 | 0.3 | 0.05 | 79 | $Cr_2O_3$ | 15 | 1.92 | 0.72 | Not occurred | 120 | Example |
| 19 | 0.3 | 0.05 | 81 | $TiO_2$ | 15 | 1.92 | 0.73 | Not occurred | 110 | Example |
| 20 | 0.3 | 0.05 | 77 | $Cr_2O_3$ | 15 | 1.94 | 0.71 | Not occurred | 140 | Example |
| | | | | $TiO_2$ | 15 | | | | | |
| 21 | 0.3 | 0.05 | 79 | $Cr_2O_3$ | 25 | 1.91 | 0.82 | Occurred | 30 | Comparative Example |
| | | | | $TiO_2$ | 25 | | | | | |
| 22 | 0.3 | 0.05 | 80 | $MnO_2$ | 3 | 1.93 | 0.71 | Not occurred | 140 | Example |
| | | | | $Fe_3O_4$ | 15 | | | | | |
| 23 | 0.3 | 0.07 | 105 | $Cr_2O_3$ | 10 | 1.91 | 0.73 | Not occurred | 140 | Example |
| | | | | $TiO_2$ | 10 | | | | | |
| 24 | 0.3 | 0.11 | 196 | $Cr_2O_3$ | 10 | 1.90 | 0.77 | Not occurred | 85 | Example |
| | | | | $TiO_2$ | 10 | | | | | |
| 25 | 0.3 | 0.15 | 238 | $MnO_2$ | 10 | 1.85 | 1.05 | Occurred | 20 | Comparative Example |
| | | | | $Fe_3O_4$ | 10 | | | | | |

As is clear from Table 3, with an appropriate Af/As ratio of the decarburization annealed sheet, $SiO_2$ grain diameter, and additive in the annealing separator, no coating peel occurred, and excellent iron loss was obtained.

The invention claimed is:

1. A grain-oriented electrical steel sheet comprising:

a steel substrate;

a forsterite base film; and an insulating coating, wherein critical damage shear stress τ between the forsterite base film and the steel substrate is 50 MPa or more and 200 MPa or less, the critical damage shear stress τ being measured in accordance with JIS R 3255, wherein the grain-oriented electrical steel sheet has a non-heat resistant magnetic domain refining region, wherein a heat-affected width w is 50 μm or more and (2τ+150) μm or less, the heat-affected width w being a width of a thermal strain portion in the non-heat resistant magnetic domain refining region and the τ is a value expressed in MPa, and wherein the grain-oriented electrical steel sheet has a coating damaged part area ratio of 10% or less.

2. The grain-oriented electrical steel sheet according to claim 1, wherein the critical damage shear stress τ between the base film and the steel substrate is 100 MPa or more and 200 MPa or less.

3. The grain-oriented electrical steel sheet according to claim 1, wherein the critical damage shear stress τ between the base film and the steel substrate is 100 MPa or more and 200 MPa or less, and wherein the grain-oriented electrical steel sheet has no coating damaged part.

* * * * *